US012790095B2

(12) United States Patent
Henry, Jr.

(10) Patent No.: US 12,790,095 B2
(45) Date of Patent: Nov. 10, 2026

(54) CORNER MOLD

(71) Applicant: Henry Molded Products Inc., Lebanon, PA (US)

(72) Inventor: Douglass C. Henry, Jr., Lebanon, PA (US)

(73) Assignee: Henry Molded Products Inc., Lebanon, PA (US)

( * ) Notice: Subject to any disclaimer, the term of this patent is extended or adjusted under 35 U.S.C. 154(b) by 0 days.

(21) Appl. No.: 19/037,223

(22) Filed: Jan. 26, 2025

(65) Prior Publication Data

US 2026/0217440 A1 Jul. 30, 2026

Related U.S. Application Data

(60) Provisional application No. 63/625,687, filed on Jan. 26, 2024.

(51) Int. Cl.
*B65D 81/05* (2006.01)

(52) U.S. Cl.
CPC ..... *B65D 81/057* (2013.01)

(58) Field of Classification Search
CPC ..... B65D 81/055; B65D 81/056
USPC ..... 206/586, 453
See application file for complete search history.

(56) References Cited

U.S. PATENT DOCUMENTS

| | | | | |
|---|---|---|---|---|
| 3,056,523 | A * | 10/1962 | Reifers | B65D 1/36 206/427 |
| 6,629,608 | B2 * | 10/2003 | Hurley | B65D 81/056 206/453 |
| 2015/0344171 | A1 * | 12/2015 | Sumitomo | B65D 81/056 206/587 |
| 2022/0154411 | A1 * | 5/2022 | Henry, Jr. | D21H 11/14 |

* cited by examiner

*Primary Examiner* — Jacob K Ackun
(74) *Attorney, Agent, or Firm* — Barley Snyder

(57) ABSTRACT

A corner mold includes a body having a plurality of side walls. The corner mold further includes an interior layer of the body. The interior layer of the body includes a plurality of elongated depressions. The corner mold further includes a plurality of side depressions positioned between the plurality of elongated depressions. The corner mold further includes an edging on the body. The edging includes a plurality of perforations positioned around a perimeter of the edging.

11 Claims, 19 Drawing Sheets

CORNER MOLD

CROSS-REFERENCE TO RELATED APPLICATION

This application claims priority to U.S. patent application Ser. No. 63/625,687 filed on Jan. 26, 2024.

FIELD OF THE INVENTION

The present invention relates to a corner mold and, more particularly, to a corner mold for providing a barrier between a corner of an object and exterior forces.

BACKGROUND

In general, corner protectors are intended to protect boxes or cornered materials from external forces. Polystyrene is a non-biodegradable solid that is resistant to chemicals and material break down. The use of disposal of polystyrene protectors, consequently, can cause significant environmental harm as discarded polystyrene will persist in the environment for centuries. Many cities and counties across the United States have passed regulations banning sale of polystyrene products for this reason. Thus, there exists a need for a disposable corner protector, that is less expensive to manufacture, and provides the benefit of being capable of being composted, bio-degraded, or recycled sustainably and effectively.

SUMMARY

A corner mold includes a body having a plurality of side walls. The corner mold further includes an interior layer of the body. The interior layer of the body includes a plurality of elongated depressions. The corner mold further includes a plurality of side depressions positioned between the plurality of elongated depressions. The corner mold further includes an edging on the body. The edging includes a plurality of perforations positioned around a perimeter of the edging.

BRIEF DESCRIPTION OF DRAWINGS

In the following, the present invention is described in more detail with references to the drawings in which.

DETAILED DESCRIPTION OF THE EMBODIMENTS

Figure 1:
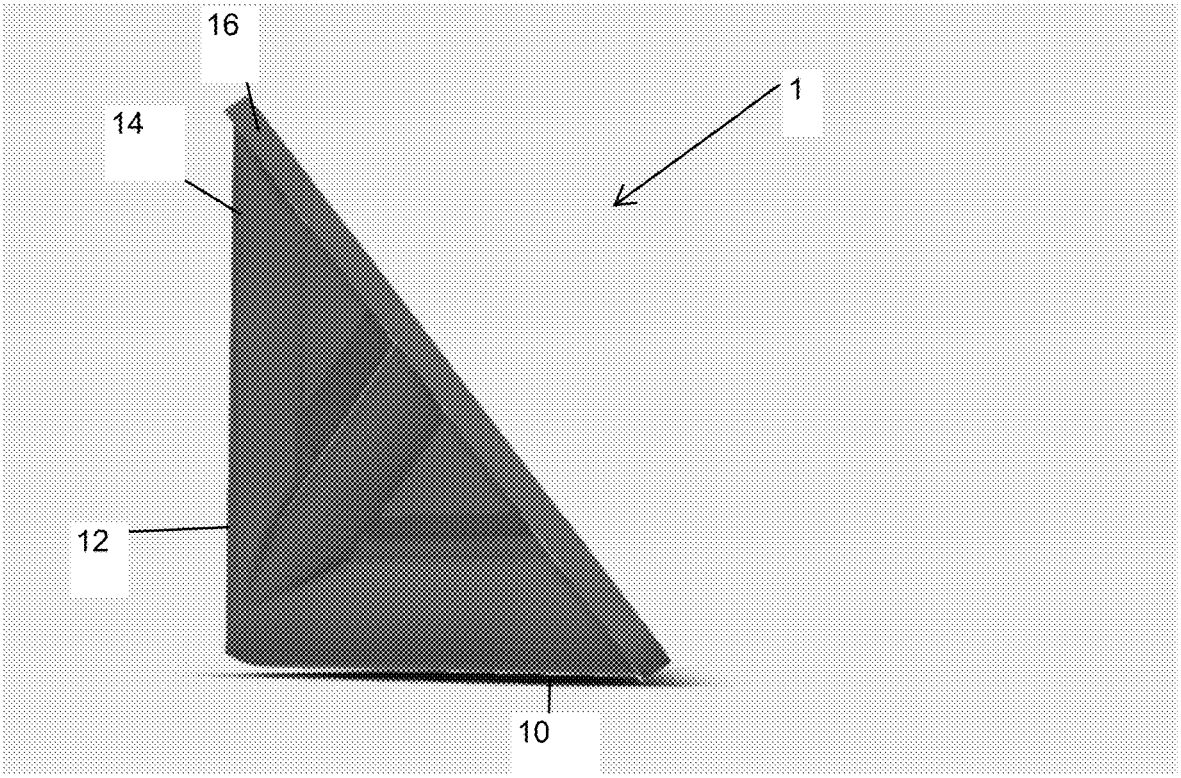
FIG. 1 illustrates a right side perspective view of a corner mold.

Hereinafter, an exemplary embodiment of the present disclosure will be described in detail with reference to the accompanying drawings. As those skilled in the art would realize, the described embodiment may be modified in various different ways, all without departing from the spirit or scope of the present disclosure. Further, throughout the specification, like reference numerals refer to like elements.

The terminology used herein is for the purpose of describing a particular exemplary embodiment only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Referring now to an exemplary embodiment of the present disclosure, the single-walled disposable corner mold 1 discussed herein can be made of a pulp-based material or fiber-based material. The pulp-based material or fiber-based material is compostable, recyclable, and/or biodegradable, such that the corner mold 1 can be disposed of in an environmentally friendly manner as the pulp-based material or fiber-based material from which the corner mold 1 is manufactured is capable of composting, or biodegrading rapidly; and furthermore, the pulp-based material or fiber-based material does not result in the release or production of toxic residues as it is composted, bio-degraded or recycled.

Figure 2:
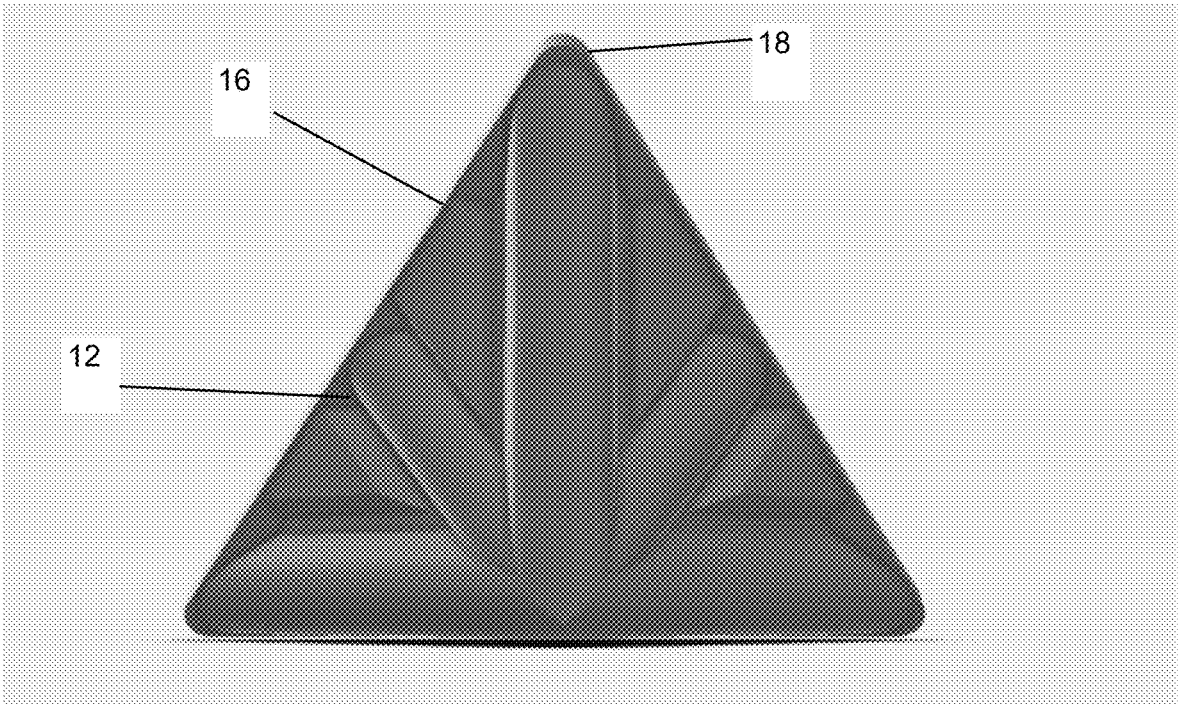
FIG. 2 illustrates a rear view perspective view of the corner mold of FIG. 1.
Figure 3:
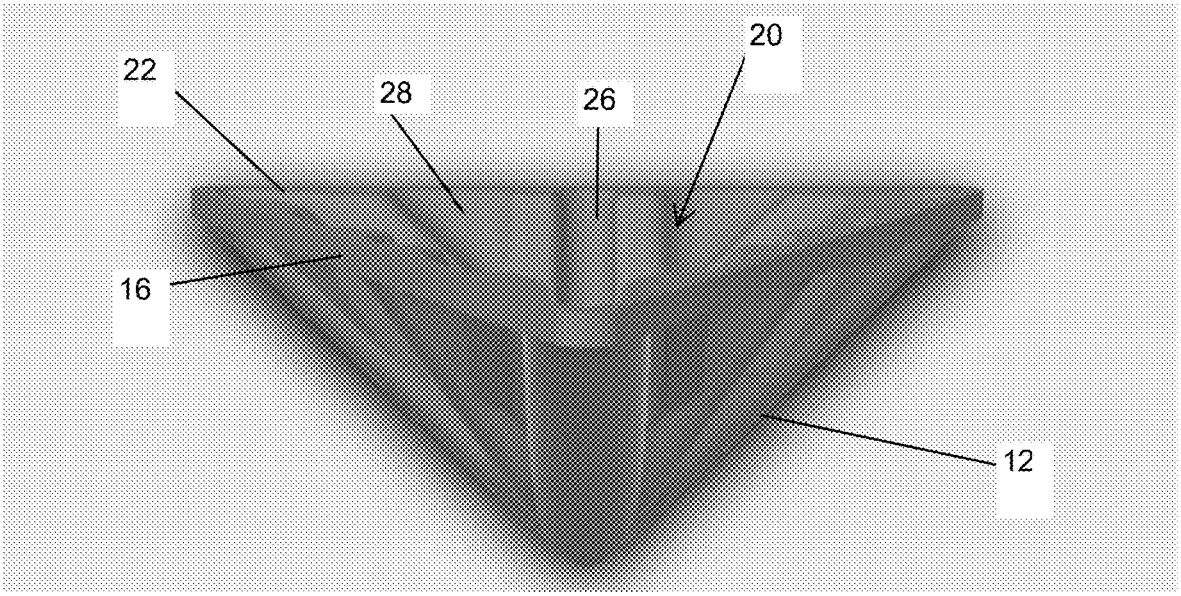
FIG. 3 illustrates a perspective view of FIG. 2.
Figure 4:
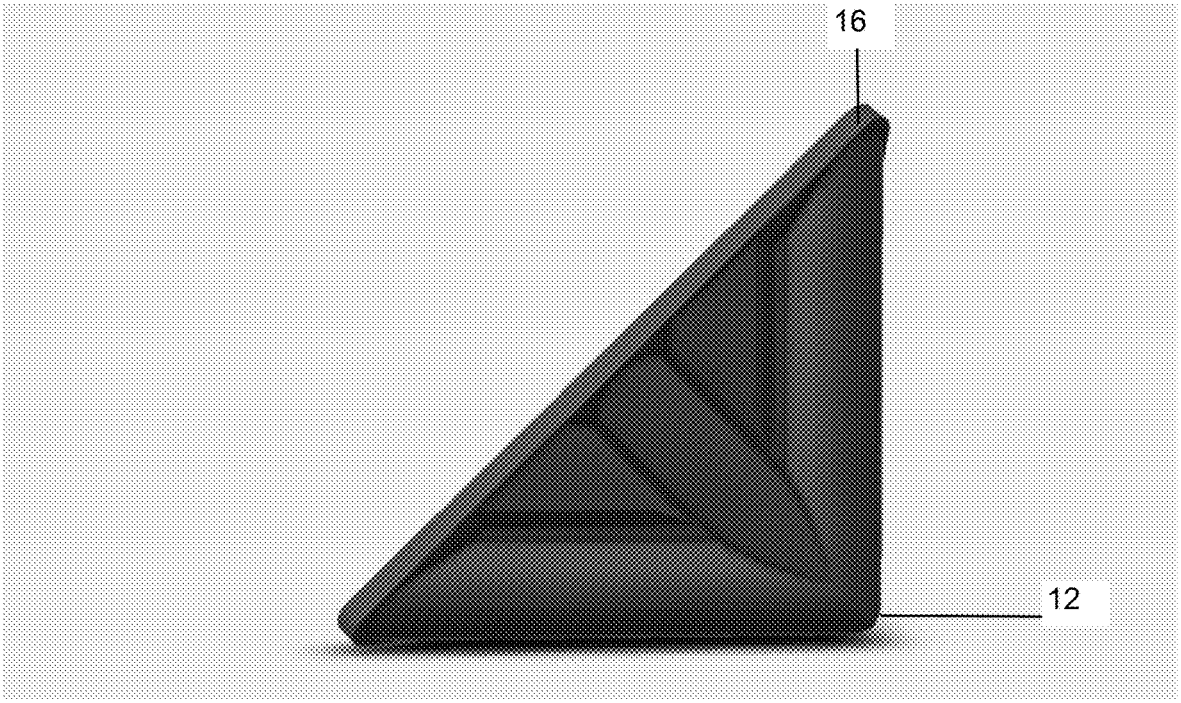
FIG. 4 illustrates a left side perspective view of the corner mold of FIG. 3.
Figure 5:
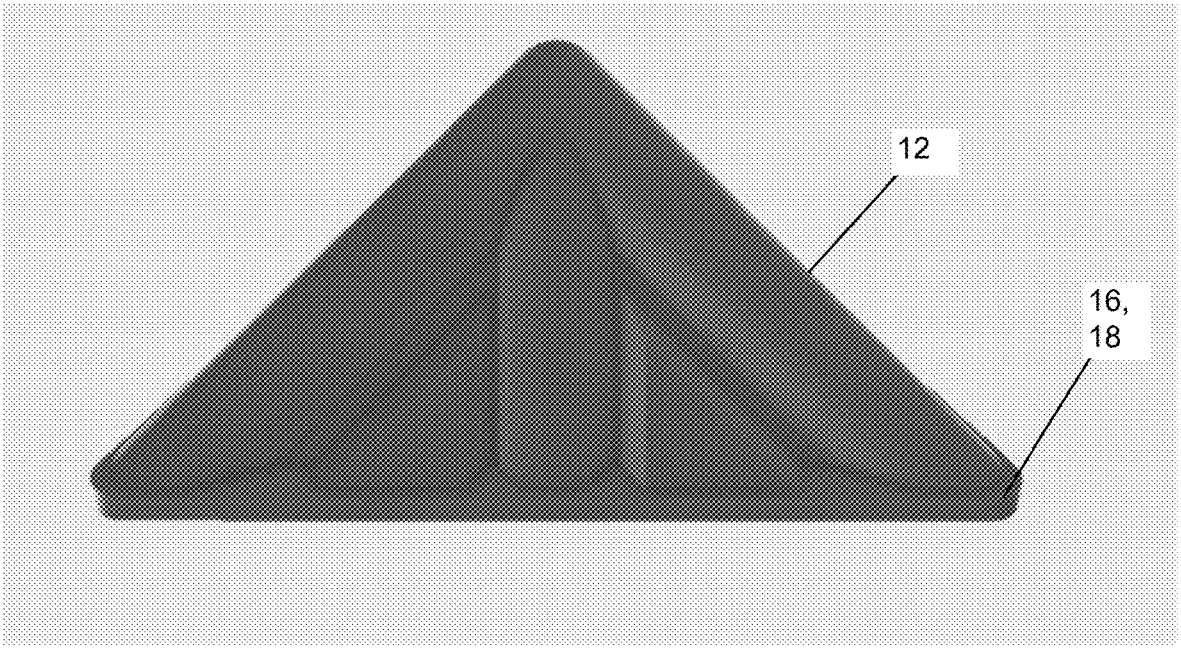
FIG. 5 illustrates a side perspective view of the corner mold of FIG. 4.
Figure 6:
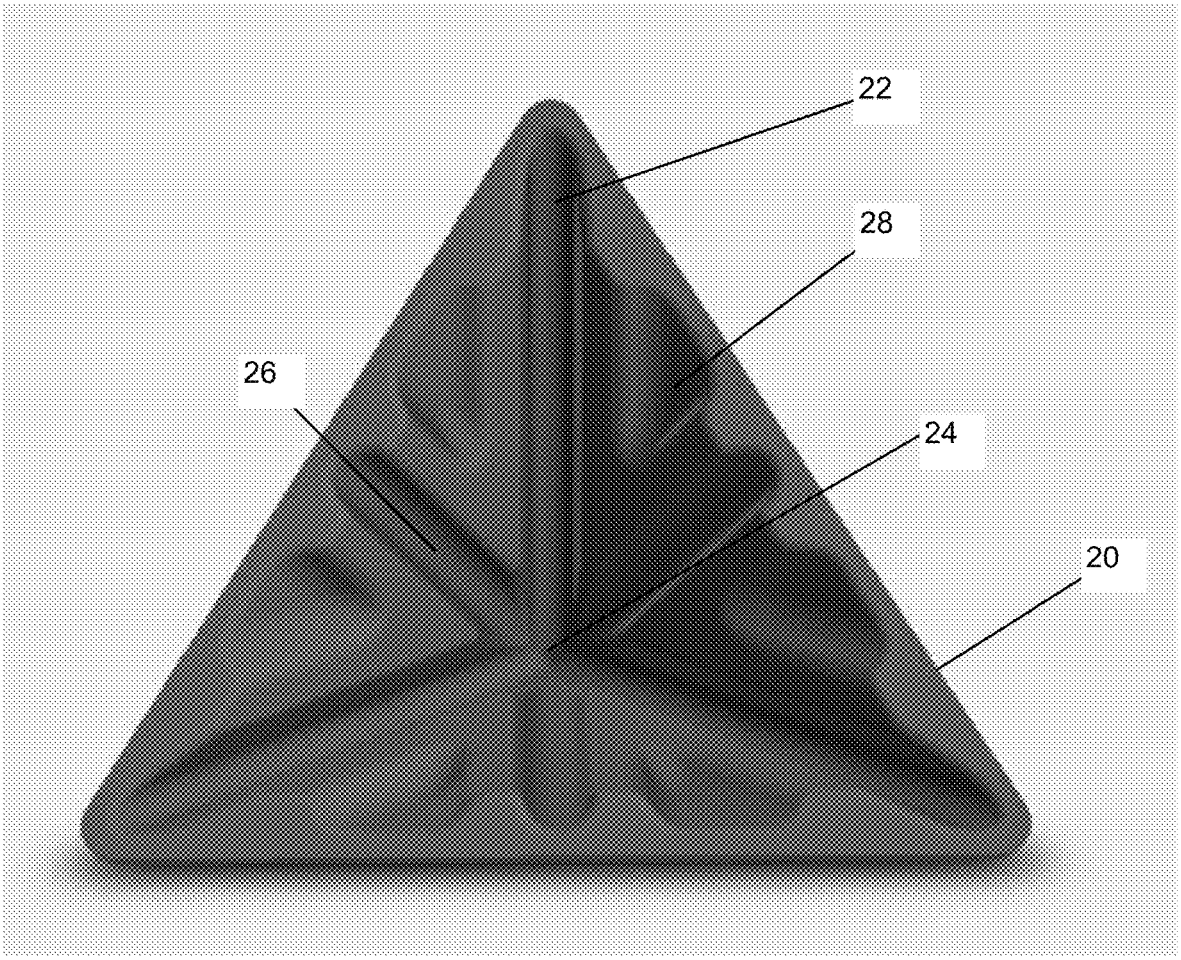
FIG. 6 illustrates a rear view of the corner mold of FIG. 5.
Figure 7:
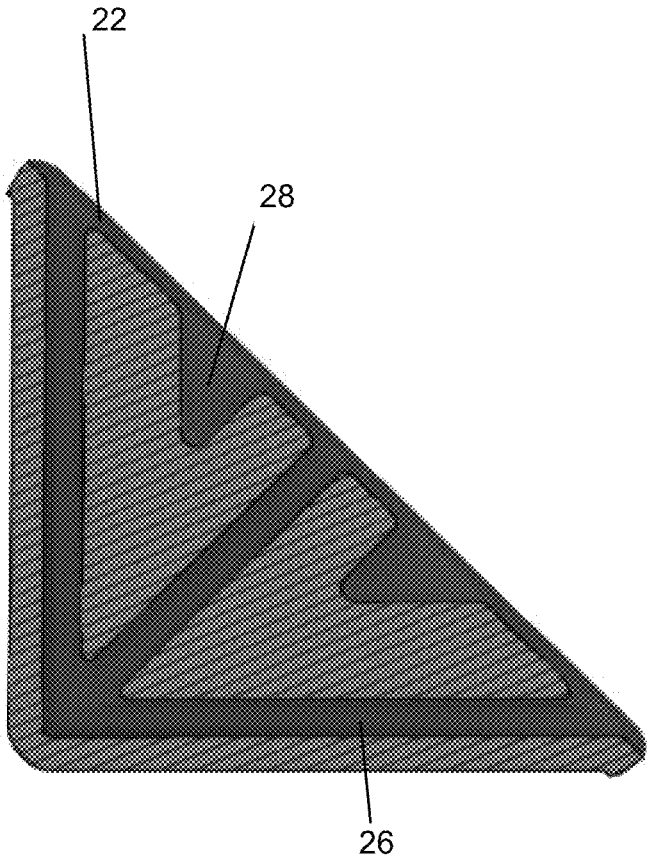
FIG. 7 illustrates a cross sectional view of the corner mold of FIG. 6.

In the exemplary embodiment as shown in FIGS. 1-7, a corner mold 1 generally includes a body 10.

The body 10 includes a plurality of side walls 12. The at least three side walls 12 generally form the shape of a triangular formation.

The body 10 further includes an exterior layer 14 and an interior layer 20.

In the exemplary embodiment, the exterior layer 14 includes an edging 16 positioned around and dividing the exterior layer 14 from the interior layer 20. The edging 16 includes a plurality of perforations 18 around a perimeter of the edging 16.

In the exemplary embodiment, the interior layer 20 includes a plurality of corner depressions 22. The at least three corner depressions 22 are elongated cylindrical members. One skilled in the art would understand the applicant's design is not the exclusive embodiment. The plurality of corner depressions 22 extend from a central interior 24 of the interior layer 20 to one of the at least three outer corners of the body 10.

The interior layer 20 further includes a plurality of side depressions 26. The at least three side depressions 26 are elongated cylindrical members. The plurality of side depressions 26 extend from the central interior 24 of the interior layer 20 to an interior side of the body 10.

The interior layer 20 further includes a plurality of indentations 28, specifically, the at least six indentations 28 are formed on the surface of the interior layer 20. Additionally, the plurality of indentations 28 are positioned and equally distributed between the plurality of corner depressions 22 and the plurality of side depressions 26.

Figure 8:
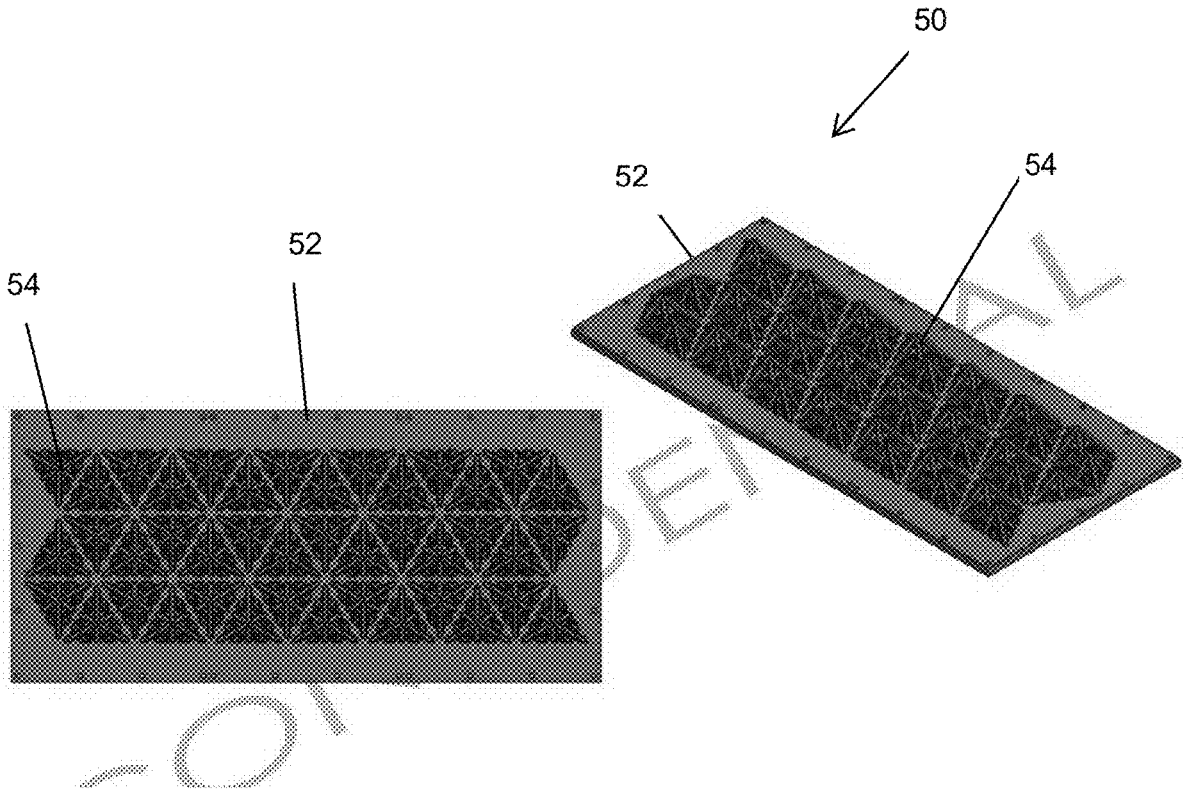
FIG. 8 illustrates a perspective view of a die sheet.
Figure 9:
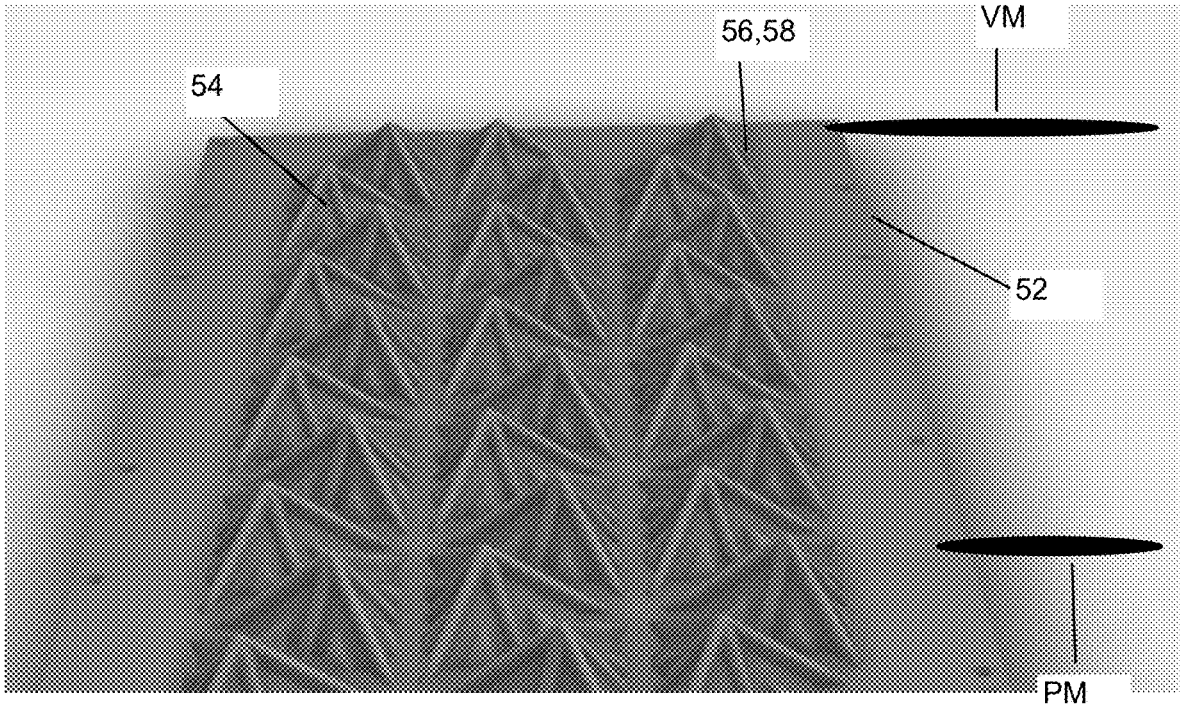
FIG. 9 illustrates a front, top perspective of the die sheet of FIG. 8.
Figure 10:
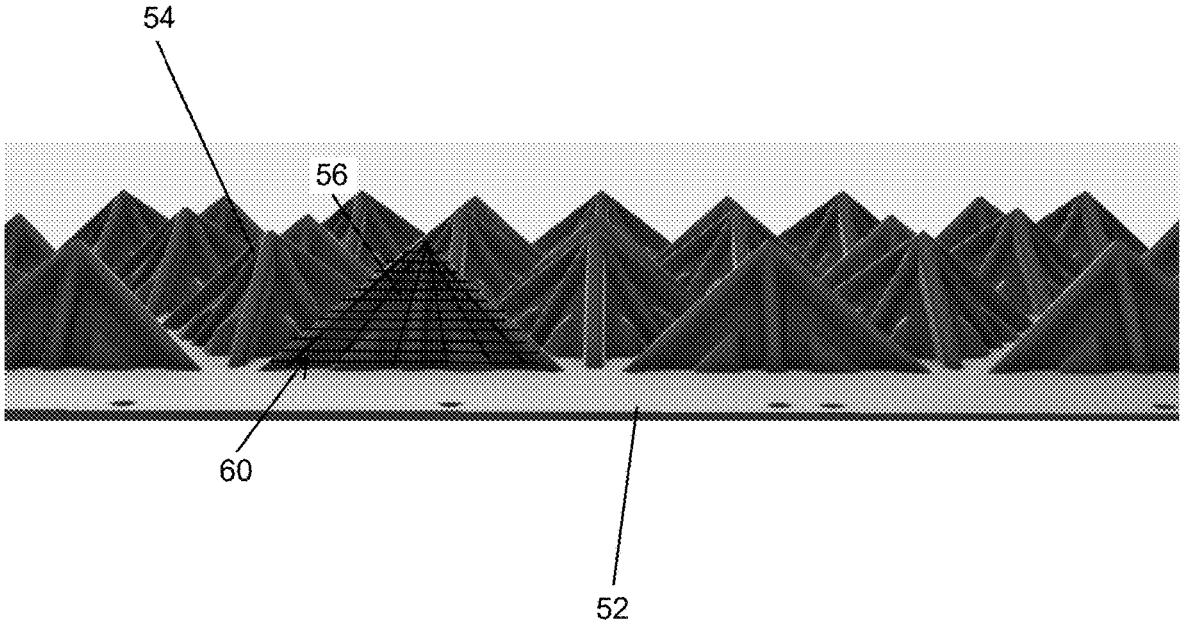
FIG. 10 illustrates a right side perspective of the die sheet of FIG. 9.
Figure 11:
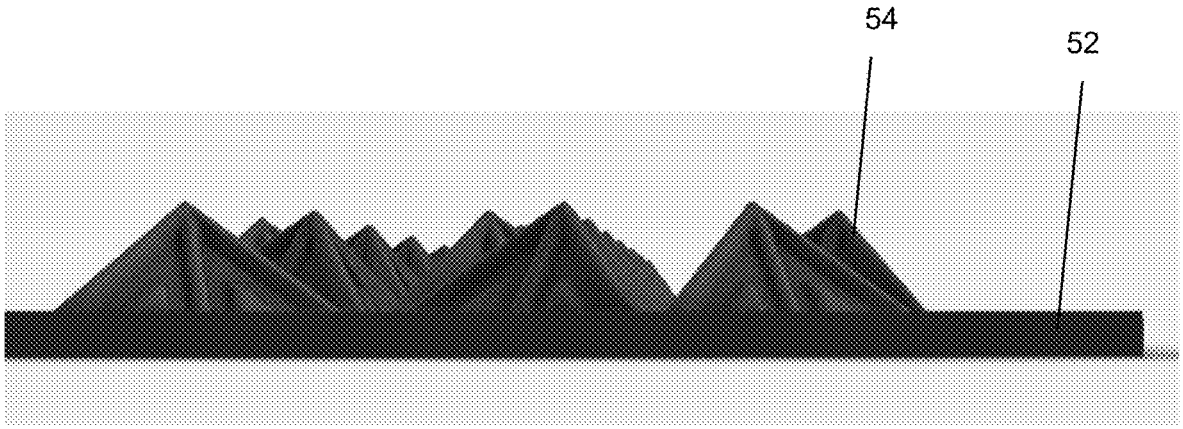
FIG. 11 illustrates a left side perspective of the die sheet of FIG. 10.
Figure 12:
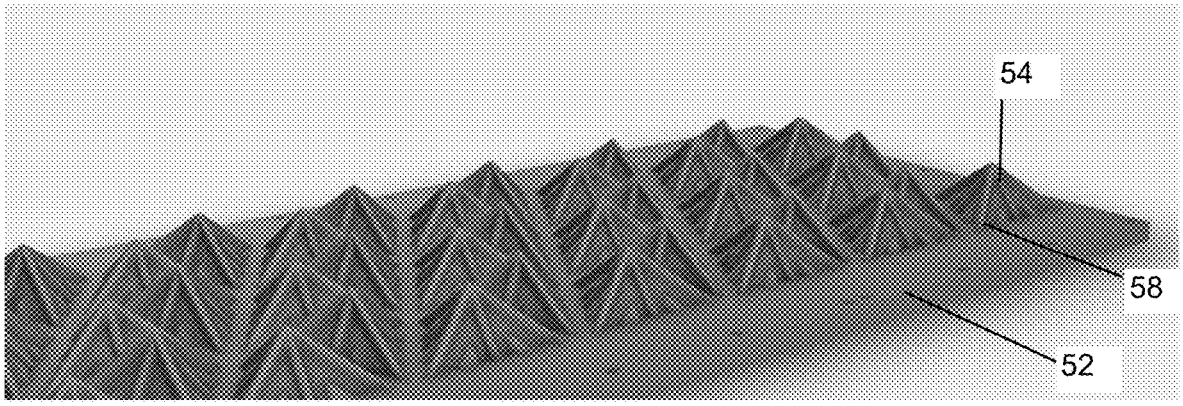
FIG. 12 illustrates a top, right side perspective view of the die sheet of FIG. 11.
Figure 13:
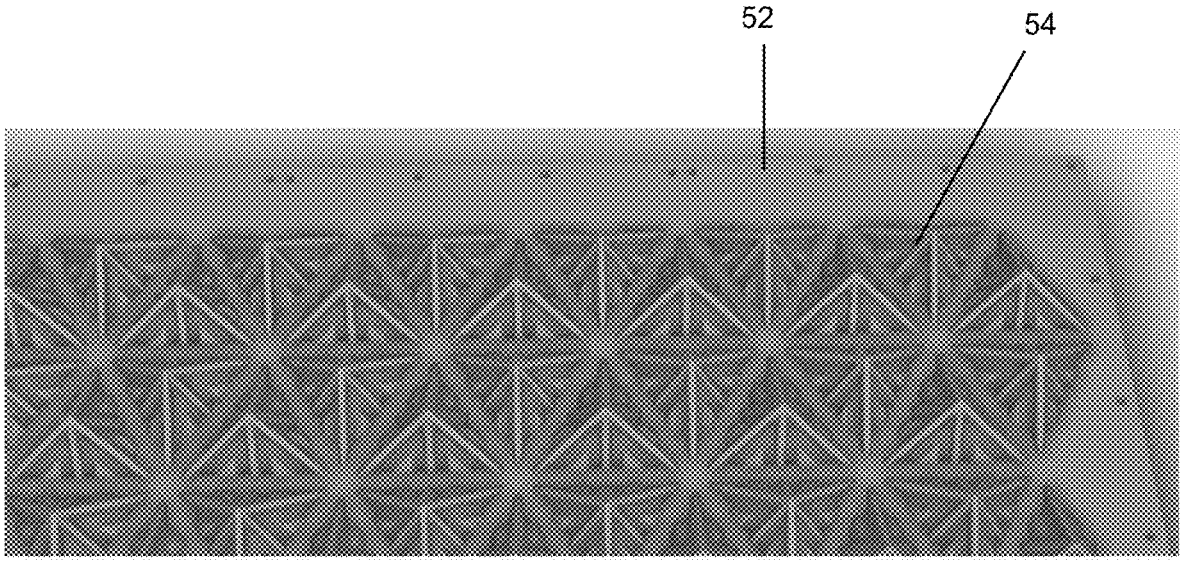
FIG. 13 illustrates a top view of the die sheet of FIG. 12.
Figure 14:
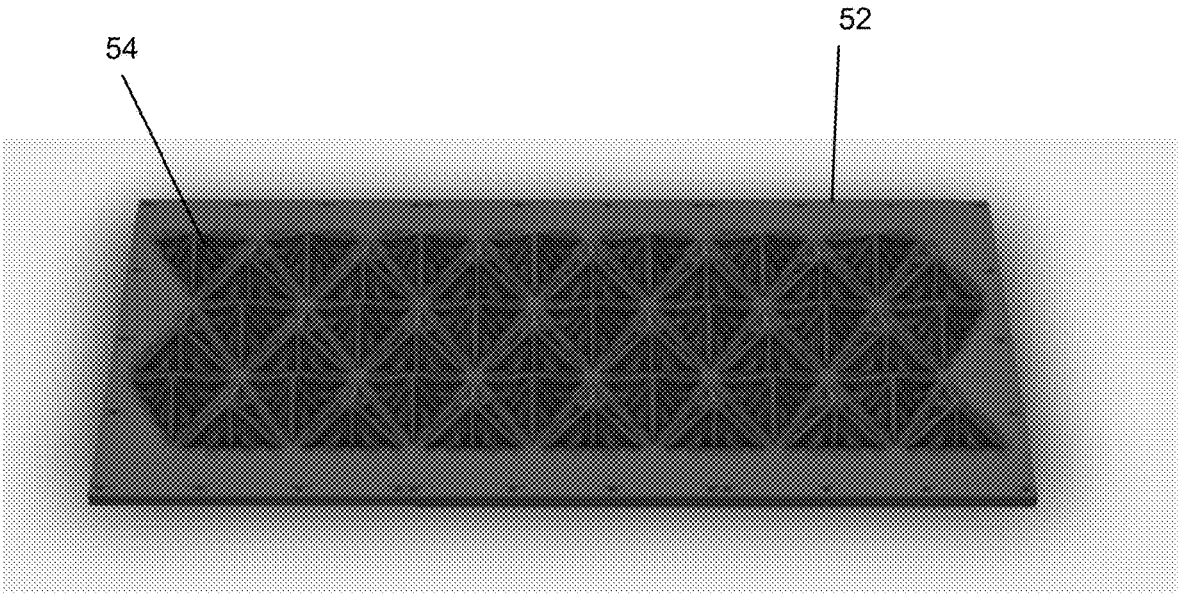
FIG. 14 illustrates another top view of the die sheet of FIG. 13.

Referring now to FIGS. 8-14, the apparatus for molding the body 10 from a fibrous slurry is shown having a forming die 50.

In the exemplary embodiment, the forming die 50 generally includes a die sheet 52, a plurality of die body molds 54, a screen 60 and a vacuum mechanism VM, and a pressure mechanism PM. The die sheet 52 is an elongated rectangular member. One skilled in the art would understand the applicant's design is not the exclusive embodiment.

In the exemplary embodiment and as shown in FIGS. 8-14, each die body mold 54 is arranged on a portion of the die sheet 52. Each die body mold 54 is arranged in an opposite direction from the adjacent die body mold 54.

In the exemplary embodiment, each die body mold 54 has a plurality of perforations 56 in fluid communication with a plurality of channels 58 extending there through, and selectively in fluid communication with a source of negative pressure through the vacuum mechanism VM.

The channels 58 extending through the die body mold 54 are also selectively in fluid communication with a source of positive pressure through the pressure mechanism PM.

Each of the vacuum mechanism VM and pressure mechanism PM may be a pipe connected to a pressure source (positive or negative, as appropriate), and may optionally include one or more valves to isolate each die body mold 54 from the positive or negative pressure source, as needed during the manufacturing process. Alternatively, the pressure (negative or positive) may be controlled away the forming die 50, such as through a valve in-line between the vacuum or pressure sources and the forming die 50. The control of the positive and/or negative pressure sources may be automatically controlled, or manually controlled, and use valving to selectively deliver positive or negative pressure (as appropriate) to the interior of the forming die 50, where the valves may be manually operated valves, or remotely controlled valves.

The die body mold 54 may be formed from any material having the characteristics of being porous or otherwise provided with the plurality of channels 58 for the passage of fluids there through. The material must also be sufficiently rigid to withstand the required positive and negative pressures in the manufacturing process, and easily shaped to permit the molding surfaces of the die body mold 54, contrary to the accepted practice, to be constructed either by hand using simple hand-held cutting tools, or by machine using relatively simple manual tools, or automatically using computer controlled cutting tools.

Accordingly, the die body mold 54 of the invention may be manufactured with significantly less time and cost than conventional forming dies which require relatively labor intensive, time consuming, and expensive molding, machining and drilling, or electroforming operations. Further, it should now be apparent that the use of materials having the above-described characteristics permits the die body mold 54 of the invention to be easily and inexpensively modified to allow for formed articles to be manufactured incorporating various design changes.

The die body mold 54 is provided with the plurality of internal channels 58, and thus acts as a manifold, where the channels 58 within the die body mold 54 are configured to distribute the vacuum from the vacuum mechanism VM that is derived from any source of negative pressure (not shown), over at least the area of the die body mold 54 that corresponds to the shape to be formed, referred to as the molding surface. Additionally, the channels 58 in the die body mold 54 are configured to distribute compressed air or other pressurized gases from the pressure mechanism PM.

At least the portion of the exterior of the die body mold 54 that is the molding surface is covered with a fine mesh screen 60 that conforms to the shape of the die body mold 54, and provides a smooth inner surface to the interior layer 20 of the corner mold body 10.

The screen 60 upon the die body mold 54 serves as a negative form of all the internal aspects of the molded fiber layer, as the outside surface of the screen 60 will be in contact with the inside surface of the molded layer of fibers.

In use, the screen 60 prevents the passage of fiber material of the pulp slurry as it is drawn by vacuum mechanism VM towards the forming die 50, but allows the water from the slurry mixture to pass through the screen 60, where the liquid can be drawn into the perforations when sucked by the vacuum mechanism VM. As the screen 60 prevents the fiber material from also being sucked through the perforations 56, the fibers will amass against the perimeter of the screen 60 and build up to form a matted layer upon the screen 60, by the continued application of vacuum mechanism VM when the forming die 50 is directed into the slurry. The screen 60 must be strong enough to resist deforming significantly under the negative pressure as the molded layer of fibrous material builds up on the outside surface of the screen 60.

In an embodiment, the screen 60 may be formed from metal mesh, though it is contemplated that other materials and forms may be utilized instead, as will be understood by those skilled in the art. For example, a plastic mesh may also be utilized in addition to, or in place of a metal mesh. The screen 60, the perforations 56, and the vacuum mechanism VM allow the fiber material to mold to the exterior portion of the forming die body mold 54, and then continued vacuum would remove enough water from the fiber material to allow the molded fibers to self-support itself once it is removed from the forming die 50. The term "self-supporting" is intended to mean there is no significant change in overall shape or form of the material attributable solely to the force of gravity acting upon the material alone; for example, where a sample molded component is placed onto a flat surface, the sample would not display a tendency to sag or collapse in any portion or dimension of the sample. A material that is "self-supporting" is not intended to exclude the movement or shifting of portions of the sample when subjected to additional forces beyond the force of gravity.

The forming die 50 is provided with the pressure mechanism PM to facilitate removal of the molded layer that makes up the corner mold body 10.

Removal of the molded fibers can be accomplished by closing off the vacuum mechanism VM, and optionally allowing the negative pressures in the die body 54 to equalize. The vacuum mechanism VM should be turned off only after the molded fibers have been dewatered to the point at which the molded fiber layer would be self-supporting, which occurs when sufficient water has been drawn out of the matted fiber layer that the fibers are not loosely matted, and unable to easily move or slide relative to each other to the point where gravity would alter the shape, but in any event before the fiber layer has dried, and the fibers are locked against each other. Once the fiber layer has been dewatered to the point it would be self-supporting, the pressure mechanism PM may be actuated or otherwise allow the delivery of a charge of pressurized air, or other gaseous fluid, through the pressure mechanism PM into the die body 54, where the channels 58 are configured to distribute the pressurized charge through the perforations 56, and against the inside surface of the molded fiber layer. The elevated pressure from within the forming die 50, acts upon the molded layer to expand at least a portion of the molded layer, such that there is a shape change from the initial molded state, and thereby facilitates removal of the molded layer of the mold body 10 from the forming die 50 while the molded layer is in a second state.

The process for manufacturing the corner mold 1 made of a pulp-based material or fiber-based material will be described.

The forming of a pulp-based material for the corner mold body 10 described herein can be performed by preparing a fibrous slurry with wood-based fibers suspended in an agitated suspension fluid, such as water. The suspension fluid as it is agitated, may optionally be subjected to heating, so as facilitate the separation of the pulp material into fibers, and optionally cause swelling of the fibers. The fibrous slurry may be prepared using, for example, pre-and post-consumer newsprint, kraft paper, and other fibers and selected waste papers which are fed into a pulping machine and mixed with water. It is also contemplated that virgin wood pulp fibers would similarly be capable of being processed according to the teachings herein, by simply being substituted like-for-like with the recycled paper to serve as the wood pulp source for processing as taught herein. In preparing the fibrous slurry, recycled paper is reduced to small pieces and then further defibered into a homogenized slurry of paper and water. During defibering, dry pulp sheets or paper are added with water and continuously agitated such that the dry pulp sheets or clean recycle paper sheets are broken down and separated into fibers, that is, to separate all of the fibers.

In an embodiment, the slurry is prepared at a ratio pulp: water, where the pulp is present within a lower range of at least 0.5% pulp fibers, at least 0.75% pulp fibers, at least 1% pulp fibers, at least 1.5% pulp fibers; and an upper range of less than 2% pulp fibers, less than 1.5% pulp fibers, less than 1% pulp fibers, with the balance being water, and optionally additives.

In an embodiment, the slurry comprising pulp fibers, water and additives is adjusted by the addition of water or additives to achieve a preferred ratio of about 1% pulp fibers, and of about 99% water and optional additives. Where the additives are to be distributed throughout the entire volume of the molded product, the additives may be incorporated into the slurry as it is agitated, to provide desirable characteristics to the entirety of the end product as the additives properties would be distributed homogenously throughout the fiber matrix to impart the beneficial property of the additive, for example, water impermeability, or increased strength and rigidity to the formed article.

According to the method of producing the corner mold 1 from a fibrous slurry of the invention, a forming die 50 comprising a water insoluble, porous (i.e., perforations 56 and screen 60), and relatively rigid and easily shaped material is provided, having a surface that serves as a negative form for the corner mold 1. The forming die 50 is then disposed into a vat having an agitated fibrous slurry. The vacuum mechanism VM, provides vacuum from a source of negative pressure to draw the fibrous slurry against the screen 60 and take on the form of the molding surface of the forming die body mold 54, as the fibers drawn towards the screen 60 amass and mat together to form a substantially uniform layer of fibrous material. The slurry water is drawn by the negative pressure through the openings in the screen 60, then through the perforations 56 in the die body mold 54, drawn into the forming die 50 and channeled to the vacuum mechanism VM. Continued application of the vacuum draws more of the slurry towards the forming die 50, after sufficient water has been drawn to obtain the required thickness of the fiber layer, the forming die 50 may be removed from the slurry. The vacuum pressure and duration necessary for drawing the fibrous slurry against the molding surfaces of the forming die 50 may be readily determined by one of ordinary skill in the art and will depend on various process conditions such as the composition and viscosity of the slurry, the temperature of the slurry, and the configuration and wall thickness of the article to be produced.

The thickness and physical characteristics of the fiber layer formed can be affected by controlling or varying manufacturing conditions as would be understood by those skilled in the art, including aspects such as, for example, the amount of negative pressure applied, the duration during which the forming die 50 is within the slurry, the duration of vacuum application, the ramp-up rate or ramp-down rate of the application of negative pressure, the slurry temperature, viscosity and density, the average fiber length, and fiber length distribution, and source of wood fiber (e.g., hardwoods, softwoods, fiber crops).

In one embodiment, when a fibrous layer has been deposited at the desired thickness, the forming die 50 is removed from the slurry. After a period of time out of the slurry, the vacuum mechanism VM may be actuated so as to remove the negative pressure and allow the negative pressure within the die body mold 54 to equalize to near ambient pressure. This may be accomplished by closure of a valve delivering the negative pressure, where the vacuum mechanism VM is a valve. The vacuum should be stopped at the point at which the molded layer would be self-supporting, were it removed from the die mold body 54, but before the molded layer is dried to the point where the fibers of the molded layer would so lock together as to prohibit some shaping of the molded layer.

After the molded layer of the corner mold 1 has dried sufficiently to the point of being self-supporting, it may be removed from the forming die 50 by hand or mechanically with the actuation of the pressure mechanism PM, to deliver a charge of pressurized air or other gaseous fluid through the die body mold 54, via channels 58 and out the perforations 56, where the elevated pressure will serve to push at least a portion of the molded layer away from the forming die 50.

In order to quickly reduce the moisture content of the molded layer after removal from the forming die 50, the molded layer may be placed into a conventional oven having a temperature of less than about 500 degrees. Additionally, the exposure to heat may beneficially act upon, or otherwise activate one or more of the additives that were in the slurry, and are now incorporated into the thickness of the material. The amount of time and the particular heating temperature may be readily determined by one of ordinary skill in the art.

In this embodiment, as the forming die 50 is removed from the slurry, and subjected to dewatering outside of the slurry by continued application of negative pressure, the resulting wet molded layer will conform to the outside surface of the forming die 50 against the screen 60, and thus, the molded layer initially conforms. The removal of the forming die 50 from the slurry, and after removing enough water from the molded layer that it would be self-supporting, the vacuum is removed and internal pressure allowed to equalize.

Before the molded layer has dried completely, a charge of high pressure air, or compressed gas, is introduced through the forming die 50 via the pressure mechanism PM. The sudden increase of pressure internal to the wet molded layer acts upon the inward curvature of the side walls 12 of the wet molded layer and causes those side wall elements to be pushed out, such that each of the side walls 12 is converted from having a first state that presents a slightly concave profile, to a second state that presents a slightly convex profile.

As the body 10 of the corner mold 1 is expanded, and released from the forming die 50, there becomes significantly less surface area inside the molded layer remaining in contact with the screen 60 that would otherwise be retaining the molded layer onto the forming die 50. The continued application of pressurized air will increase the pressure inside the molded layer above ambient pressure, to the point that the elevated air pressure causes the molded layer to be completely released from the forming die 50.

The wet molded layer, now freed from the, and still self-supporting, may then be subjected to drying, typically through exposure to heat that will drive off the retained moisture within the molded layer to form the dry molded product. Notably, the removal of the moisture will promote fiber to fiber bonding that will lock the fibers making up the component into a three-dimensional interlocked matrix. Due to the dried nature of the wood pulp fiber matrix, the dry molded product will be strong, resilient and lightweight.

The drying of the wet molded product is performed at a temperature that will drive the moisture out of the molded article, and may also beneficially, cause the additives incorporated into the slurry to melt and coat the fibers that form the molded component. In an embodiment, the temperature for drying the wet molded product is less than 500 degrees Fahrenheit, and greater than room temperature. For example, where paraffin wax is incorporated into the slurry, the heat of drying the molded component, will melt the wax, and be distributed throughout the fibers. Once cooled, the wax would solidify as a hydrophobic coating extending through the matrix of the fibers. It is contemplated that a resorbable polymer having a melting point below the drying temperature may behave similarly. Alternatively, post drying treatments may be applied to the molded articles, such as applying a thin coating of a plastic, such as PLA or PGA to the interior surface of the corner mold 1 to provide an impermeable barrier layer to the interior layer of the body 10 of the corner mold 1. By using resorbable plastics, such as PLA or PGA for this application, the corner mold 1 would remain biodegradable, compostable, or recyclable.

Figure 15:
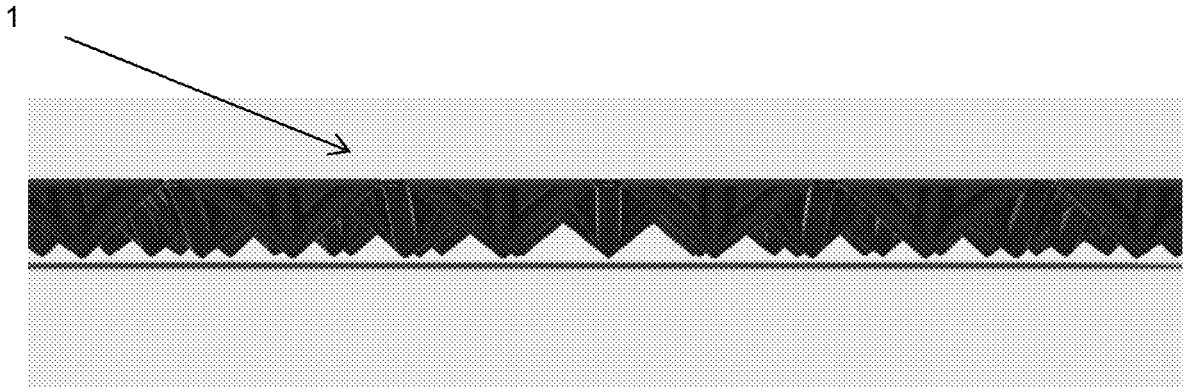
FIG. 15 illustrates a right side view of a plurality of corner molds of FIG. 14.
Figure 16:
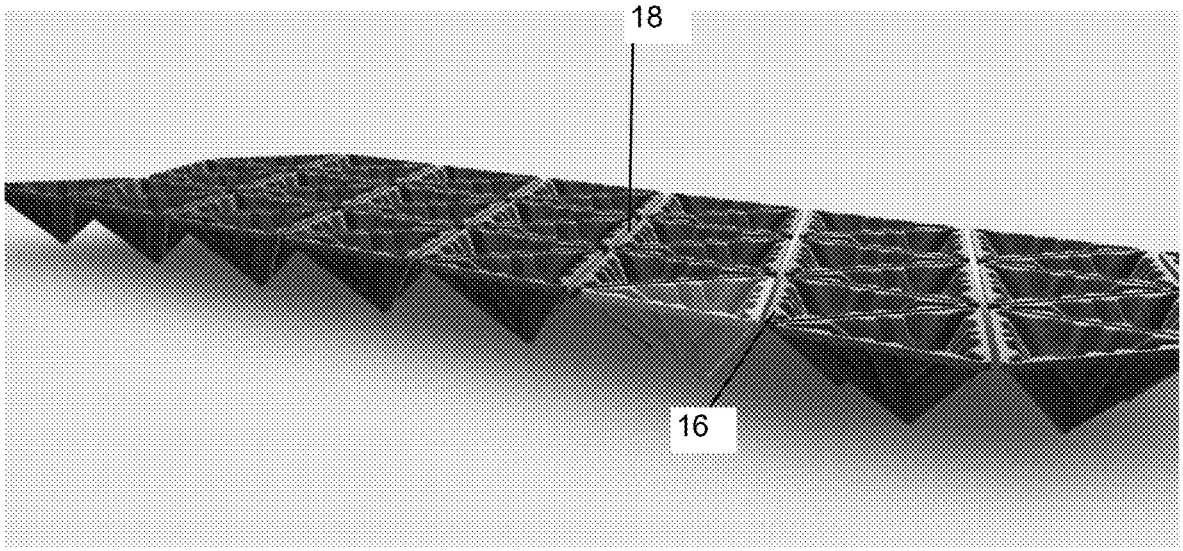
FIG. 16 illustrates a top, right side perspective view of the plurality of corner molds.
Figure 17:
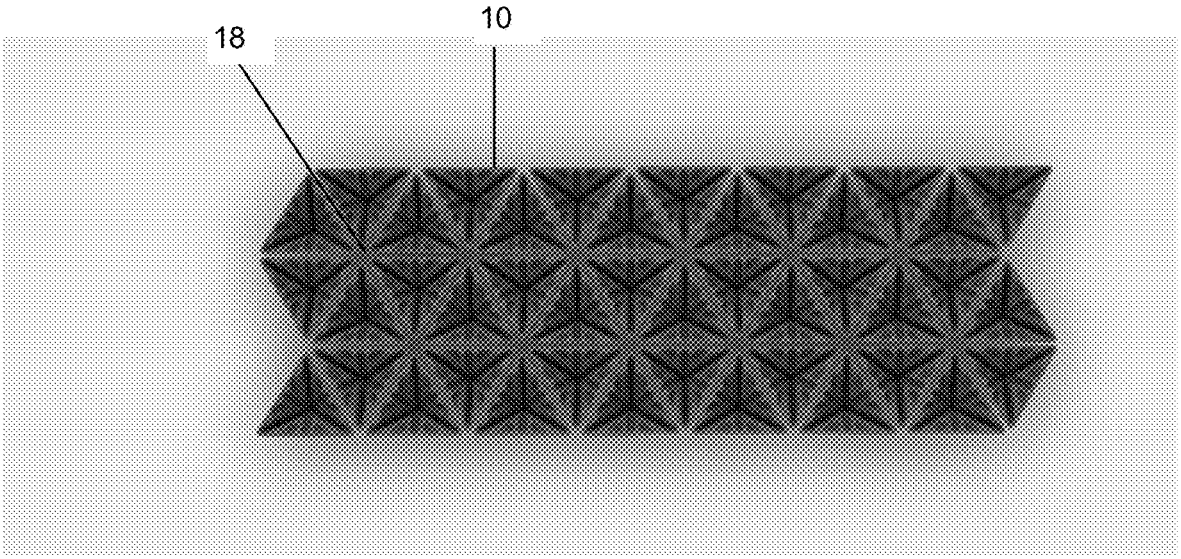
FIG. 17 illustrates a top perspective view of the plurality of corner molds of FIG. 16.
Figure 18:
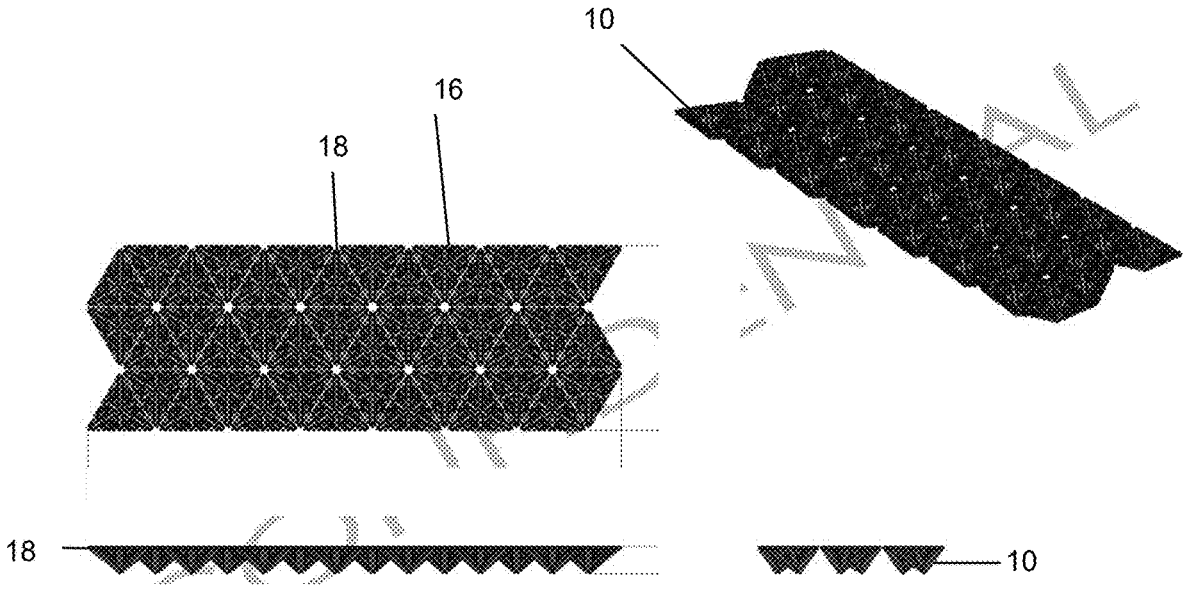
FIG. 18 illustrates another perspective view of the plurality of corner molds of FIG. 17.
Figure 19:
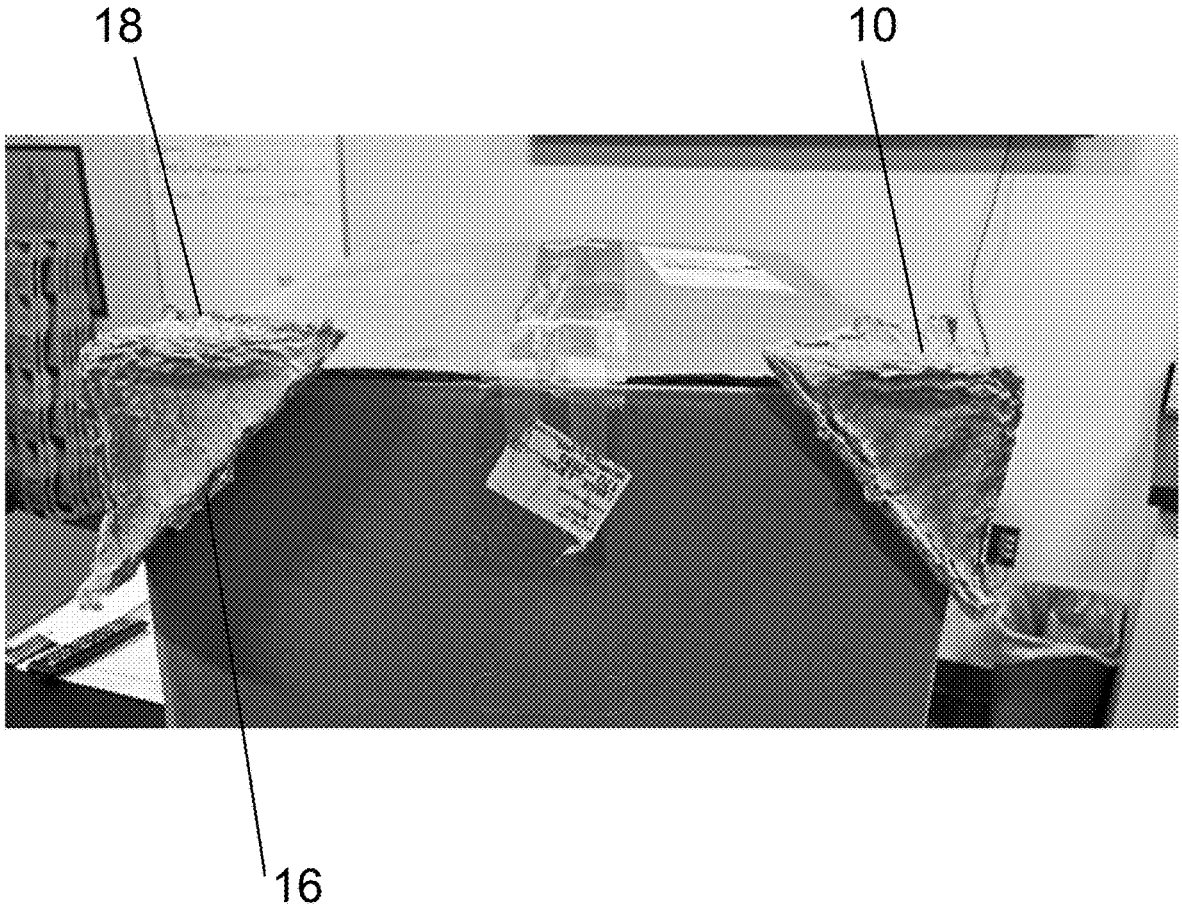
FIG. 19 illustrates the corner mold in use.

In the exemplary embodiment and as shown in FIGS. 15-19, once the corner mold 1 is complete, the user will be permitted to break a corner mold 1 from a sheet of corner molds 1 by the perforations 18 positioned on the edging 16 that attaches adjacent corner molds together. Once the corner mold 1 is detached, the corner mold can be positioned on a desired area.

What is claimed is:

1. A corner mold, comprising:

a pulp-based body having a plurality of side walls;

an interior layer of the body includes a plurality of elongated corner depressions;

a plurality of side depressions positioned between the plurality of elongated corner depressions; and an edging on the body, the edging includes a plurality of perforations positioned around a perimeter of the edging.

2. The corner mold of claim 1, wherein the plurality of side walls form a triangular formation.

3. The corner mold of claim 2, wherein the edging is positioned on an exterior layer of the body.

4. The corner mold of claim 3, wherein the edging divides the exterior layer from the interior layer.

5. The corner mold of claim 4, wherein the plurality of elongated corner depressions extend from a central interior of the interior layer to an outer corner of the interior layer.

6. The corner mold of claim 1, wherein the plurality of side depressions are elongated cylindrical members.

7. The corner mold of claim 5, wherein the plurality of side depressions extend from the central interior of the interior layer to an interior side of the body.

8. The corner mold of claim 7, wherein the corner mold further includes a plurality of indentations on the interior layer.

9. The corner mold of claim 8, wherein the plurality of indentations are positioned and equally distributed between the plurality of elongated corner depressions and the plurality of side depressions.

10. The corner mold of claim 1, wherein the interior layer provides a smooth inner surface.

11. The corner mold of claim 10, wherein an exterior layer provides a rough outer surface.

* * * * *